US005353778A

United States Patent [19]

Blankenship

[11] Patent Number: 5,353,778

[45] Date of Patent: Oct. 11, 1994

[54] ADJUSTABLE ARROW REST APPARATUS

[76] Inventor: Harry J. Blankenship, Rte. 1, Box 229, Callaway, Va. 24067

[21] Appl. No.: 65,365

[22] Filed: May 24, 1993

[51] Int. Cl.[5] ..... F41B 5/22

[52] U.S. Cl. ..... 124/44.5; 124/24.1

[58] Field of Search ..... 124/23.1, 24.1, 25.6, 124/44.5, 86, 88

[56] References Cited

U.S. PATENT DOCUMENTS

| | | | |
|---|---|---|---|
| 3,494,347 | 2/1970 | Saunders | 124/44.5 X |
| 3,867,920 | 2/1975 | Westphal | 124/44.5 X |
| 4,608,959 | 9/1986 | Seynaeve | 124/24.1 |
| 4,791,907 | 12/1988 | Corley | 124/44.5 |
| 4,827,895 | 5/1989 | Troncoso | 124/44.5 |
| 5,213,090 | 5/1993 | Tone | 124/44.5 |

*Primary Examiner*—Randolph A. Reese
*Assistant Examiner*—John A. Ricci
*Attorney, Agent, or Firm*—E. Michael Combs

[57] ABSTRACT

At arrow rest structure mounted to an archery bow handle is provided to position a generally L-shaped arrow support bracket in a pivotal relationship to provide for ease of projection and alignment of the arrow thereon as it is directed across the support bracket to include a fibrous liner onto a convex support base to accommodate the arrow thereon. The L-shaped arrow support is provided with a fibrous liner to guide an arrow therealong.

2 Claims, 4 Drawing Sheets

ADJUSTABLE ARROW REST APPARATUS

BACKGROUND OF THE INVENTION

1. Field of the Invention

The field of invention relates to archery apparatus, and more particularly pertains to a new and improved adjustable arrow rest apparatus arranged to position and enhance aiming of an arrow relative to an archery bow handle.

2. Description of the Prior Art

Arrow rest apparatus of various types have been utilized throughout the prior art as exemplified by the U.S. Pat. Nos. 5,065,731; 5,052,364; 4,967,722; and 4,947,823.

The instant invention attempts to overcome deficiencies of the prior art by providing for an organization arranged for ease of mounting and use relative to an archery bow and in this respect the present invention substantially fulfills this need.

SUMMARY OF THE INVENTION

In view of the foregoing disadvantages inherent in the known types of arrow rest apparatus now present in the prior art, the present invention provides an adjustable arrow rest apparatus wherein a generally L-shaped support bracket having a fibrous liner is arranged to support in adjustable relationship relative to an associated archery bow an arrow directed therealong. As such, the general purpose of the present invention, which will be described subsequently in greater detail, is to provide a new and improved adjustable arrow rest apparatus which has all the advantages of the prior art arrow rest apparatus and none of the disadvantages.

To attain this, the present invention provides an arrow rest structure mounted to an archery bow handle to position a generally L-shaped arrow support bracket in a pivotal relationship to provide for ease of projection and alignment of the arrow thereon as it is directed across the support bracket.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable arrow rest apparatus which has all the advantages of the prior art arrow rest apparatus and none of the disadvantages.

It is another object of the present invention to provide a new and improved adjustable arrow rest apparatus which may be easily and efficiently manufactured and marketed.

It is a further object of the present invention to provide a new and improved adjustable arrow rest apparatus which is of a durable and reliable construction.

An even further object of the present invention is to provide a new and improved adjustable arrow rest apparatus which is susceptible of a low cost of manufacture with regard to both materials and labor, and which accordingly is then susceptible of low prices of sale to the consuming public, thereby making such adjustable arrow rest apparatus economically available to the buying public.

Still yet another object of the present invention is to provide a new and improved adjustable arrow rest apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
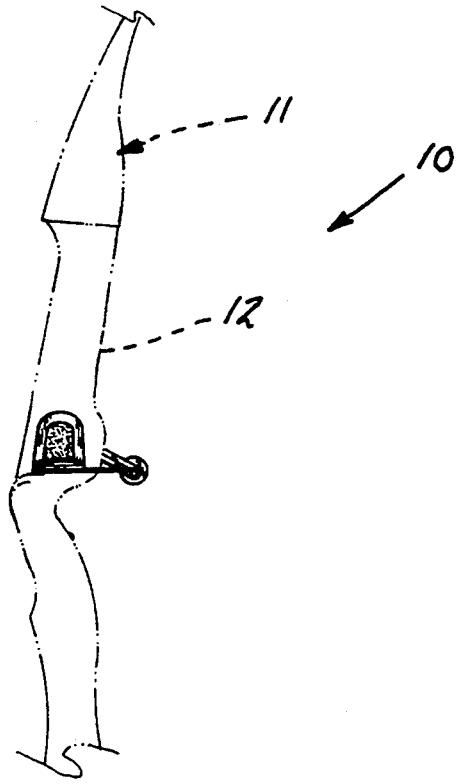
FIG. 1 is an isometric illustration of the invention mounted to an archery bow.

With reference now to the drawings, and in particular to FIGS. 1 to 8 thereof, a new and improved adjustable arrow rest apparatus embodying the principles and concepts of the present invention and generally designated by the reference numeral 10 will be described.

More specifically, the adjustable arrow rest apparatus 10 of the instant invention essentially comprises mounting to an archery bow 11, having a bow handle 12, wherein the apparatus includes a mounting plate 13 having a mounting plate fastener 14 directed orthogonally through the mounting plate 13 at the mounting plate first end fixedly securing the mounting plate to the archery bow to a first side of the handle, such that a mounting plate second end includes an externally threaded adjuster rod 15 directed orthogonally therethrough parallel to the mounting plate fastener, with the adjuster rod 15 extending from the mounting plate and orthogonally supporting a support plate 17 thereon at a second end of the rod 15 and at a first end of the support plate, wherein the support plate 17 extends parallel to the mounting plate 13, and wherein a second end of the support plate includes an L-shaped support bracket 18 fixedly secured thereon. The support bracket 18 includes a first plate 19 mounted in a parallel relationship relative to the support plate and a second plate 20 fixedly mounted and is illustrated in an orthogonal relationship, but it is understood that various oblique orientations of the second plate 20 to the first plate 19 are available. As illustrated, a fibrous liner 21 is arranged and fixedly secured within the L-shaped bracket onto the first and second plates to support an arrow therealong. The liner 21 includes an arcuate convex base 21*a* to insure the arrow clearance during use to avoid contact with the adjuster rod 15 and support plate.

Figure 3:
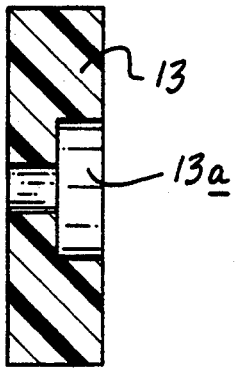
FIG. 3 is an orthographic view, taken along the lines 3—3 of FIG. 2 in the direction indicated by the arrows.

Further, as required, a clamp fastener 22 is directed through the mounting plate 13 intersecting the adjuster rod 15 to provide for fixed securement of the adjuster rod in a rotative relationship relative to the mounting plate 13. Further, as illustrated in FIG. 3, an aperture 13*a* is arranged with a countersunk portion to receive the mounting plate fastener 14.

Figure 2:
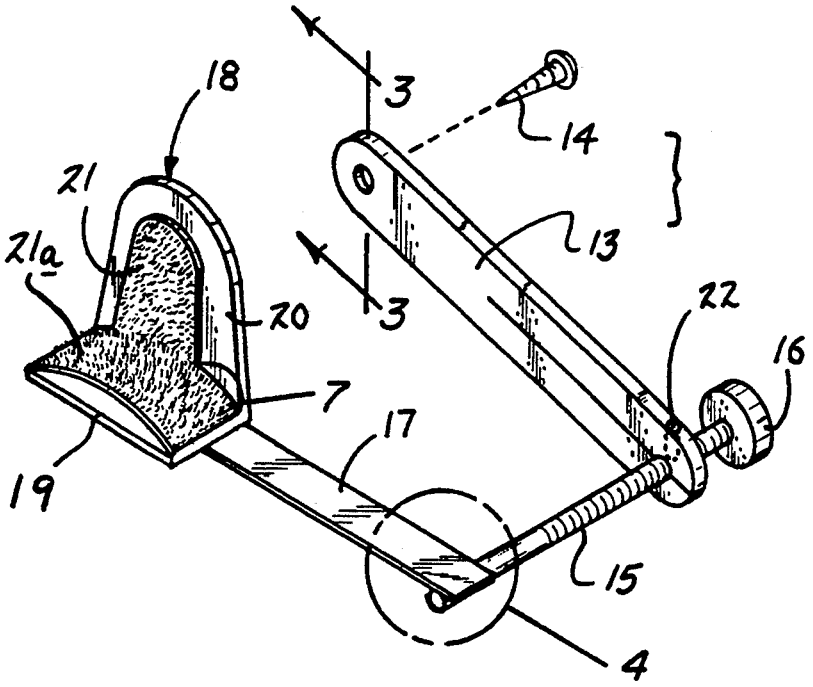
FIG. 2 is an isometric illustration of the invention and various components thereof.
Figure 4:
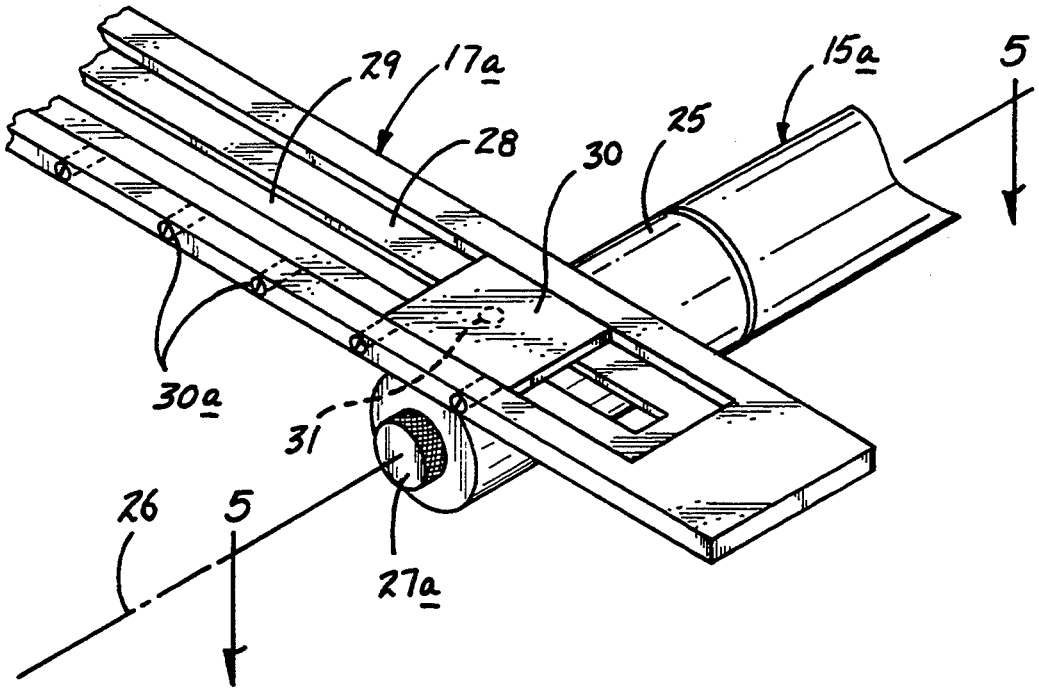
FIG. 4 is an isometric modified aspect of the invention relative to a modified adjuster rod mounting a modified support plate.
Figure 5:
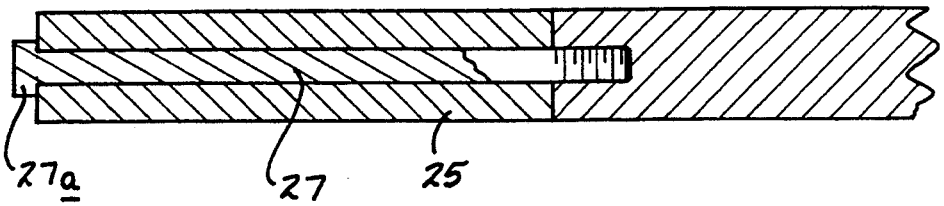
FIG. 5 is an orthographic view, taken along the lines 5-5 of FIG. 4 in the direction indicated by the arrows.

The FIG. 4 indicates a modified adjuster rod 15*a* mounted to the support plate 17, in a manner as depicted in FIG. 2, wherein the support plate 17*a* is a modified construction relative to the modified adjuster rod such that a track 28 is recessed within a top surface of the support plate 17*a*, with a track slot 29 directed through the track in a parallel relationship. A follower plate 30 is mounted within the track 28, having a follower fastener 30*a* integrally secured to the follower plate 30 and to a sleeve member 25 that is coaxially aligned relative to the adjuster rod 15*a*. The modified adjuster rod 15*a*, as indicated coaxially aligned along the axis 26 as well as the sleeve 25, is arranged to include a sleeve faster 27 coaxially aligned along the axis 26 threadedly received within the adjuster rod 15. The sleeve fastener 27 includes a fastener head 27*a* for engaging the sleeve 25 and securing the sleeve against the adjuster rod 15*a*. In this manner, the follower 30 may be slid along the track 28 upon rotation of the sleeve 25 relative to the adjuster rod 15. A plurality of follower fasteners 30*a* directed through the support plate 17 engage the follower to permit adjusted locking of the follower within the track 28.

Figure 6:
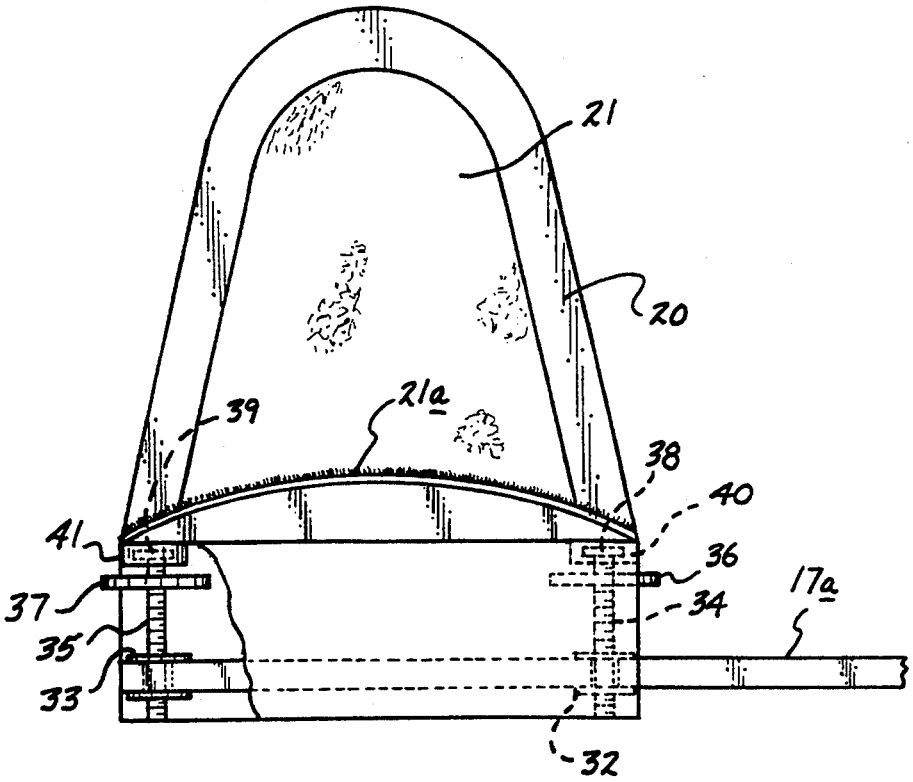
FIG. 6 is an orthographic view of the L-shaped support bracket adjustably mounted relative to the support plate.

The FIG. 6 indicates the use of the support bracket 18 mounted for vertical adjustment relative to the modified support plate 17*a* such that a plurality of externally threaded collar rods 34 are threadedly directed through individual and respective first and second support plate threaded collars 32 and 33, with the first and second externally threaded collar rods 34 and 35 arranged in a parallel relationship, each having respective first and second rod heads 38 and 39 rotatably secured within respective first and second plate bearing collars 40 and 41 mounted to a bottom surface of the first plate 19, with the first and second collar rods 34 and 35 having respective first and second handle discs 36 and 37 projecting beyond the first plate 19 permitting ease of rotation and manipulation of the rods for adjusted displacement of the support bracket 21.

Figure 7:
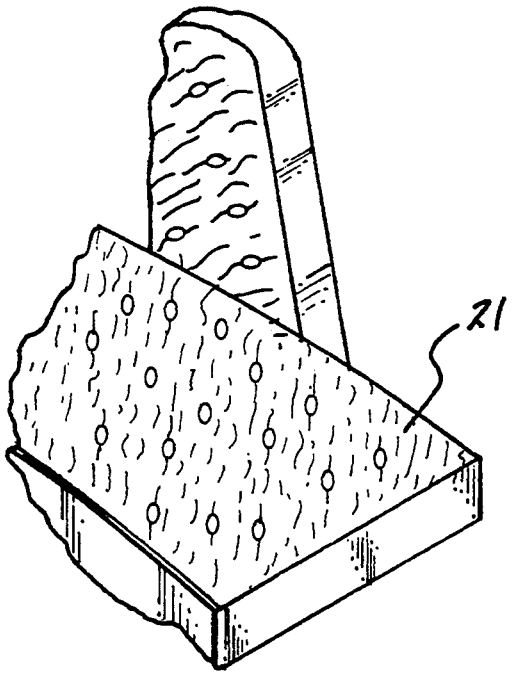
FIG. 7 is an isometric partial view of the fibrous liner structure.
Figure 8:
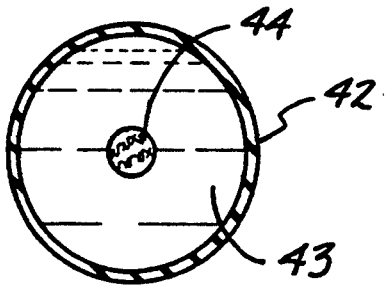
FIG. 8 is a cross-sectional illustration of an individual fiber mounting a fluid capsule, as illustrated in FIG. 7.

The FIGS. 7 and 8 indicates the use of a plurality of the individual liner fibers 44 mounting a fluid capsule 42 having a lubricant 43 therewithin, whereupon arrows directed across the liner 21 are lubricated in use and when the capsules 42 are spent, the liner is merely replaced by any suitable adhesive and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable arrow rest apparatus for mounting to an archery bow, having an archery bow handle, wherein the apparatus comprises, a mounting plate, the mounting plate having a mounting plate first end spaced from a mounting plate second end, with a mounting plate fastener orthogonally directed through the mounting plate adjacent the mounting plate first end for reception within the archery bow handle, and an externally threaded adjuster rod threadedly directed through the mounting plate adjacent the mounting plate second end, and the adjuster rod having adjuster rod first end including an adjuster handle, and the adjuster rod having an adjuster rod second end, wherein the adjuster rod second end includes a support plate fixedly mounted relative to the adjuster rod second end, with the support plate having a support plate first end fixedly secured to the adjuster rod, and a support plate second end, wherein the support plate second end includes an L-shaped support bracket secured to the support plate adjacent the support plate second end, whereupon rotation of the adjuster rod effects pivoting of the support bracket about the adjuster rod, and the support bracket includes a first plate fixedly mounted in a parallel relationship relative to the support plate, and a second plate integrally mounted to the first plate at an oblique angle, and a fibrous liner mounted onto the first plate and the second plate, with the fibrous liner of a generally L-shaped configuration and including a convex arcuate liner portion projecting from the first plate, and a clamp fastener directed through the mounting, plate intersecting the adjuster rod permitting fixed securement of the adjuster rod relative to the mounting plate, and the adjuster rod is coaxially aligned along a predetermined axis arid includes a sleeve having the adjuster rod second end, the sleeve coaxially aligned along the axis, and a sleeve fastener having a sleeve head arranged for abutment with the sleeve, and wherein the sleeve fastener is coaxially aligned along the axis, and the sleeve fastener threadedly received within the adjuster rod, and the support plate having a support plate track longitudinally aligned relative to the support plate, with the track including a track slot directed through the track, and a follower plate slidably mounted within the track, the follower plate having a follower fastener integrally securing the follower plate to the sleeve, and the support plate including at least one follower fastener threadedly directed through the support plate intersecting the follower plate within the track.

2. An apparatus as set forth in claim 1 wherein the support plate includes a first and second support plate threaded collar mounted within the support plate adjacent the support plate second end, and a first and second externally threaded collar rod threadedly directed through the respective first and second support plate threaded collar, with the first and second collar rod having a respective first and a second rod head, and the first plate having a first plate bearing collar and a second plate bearing collar rotatably mounting in a captured relationship the first rod head and the second rod head therewithin, and the first collar rod including a first rod handle, and the second collar rod including a second rod handle, wherein the first rod handle and the second rod handle project beyond the first plate arranged for access to the first rod handle and the second rod handle for manipulation of the first collar rod and the second collar rod respectively.

* * * * *